US006851476B2

(12) United States Patent
Gray et al.

(10) Patent No.: US 6,851,476 B2
(45) Date of Patent: Feb. 8, 2005

(54) DUAL SENSOR FREEPOINT TOOL

(75) Inventors: Kevin L. Gray, Friendswood, TX (US); James D. Estes, Arlington, TX (US)

(73) Assignee: Weather/Lamb, Inc., Houston, TX (US)

( * ) Notice: Subject to any disclaimer, the term of this patent is extended or adjusted under 35 U.S.C. 154(b) by 0 days.

(21) Appl. No.: 10/211,252

(22) Filed: Aug. 2, 2002

(65) Prior Publication Data

US 2003/0024702 A1 Feb. 6, 2003

Related U.S. Application Data

(60) Provisional application No. 60/310,124, filed on Aug. 3, 2001.

(51) Int. Cl.[7] ..... E21B 47/00

(52) U.S. Cl. ..... 166/301; 166/66

(58) Field of Search ..... 166/66, 301, 250.13; 73/152.56

(56) References Cited

U.S. PATENT DOCUMENTS

| | | | | | |
|---|---|---|---|---|---|
| 761,518 | A | | 5/1904 | Lykken | |
| 1,324,303 | A | | 12/1919 | Carmichael | |
| 1,952,652 | A | | 3/1934 | Brannon | 81/194 |
| 2,695,449 | A | | 11/1954 | Chauvin | 30/107 |
| 2,746,550 | A | | 5/1956 | Mitchell, Jr. | 166/4 |
| 3,087,546 | A | | 4/1963 | Woolley | 166/46 |
| 3,095,736 | A | * | 7/1963 | Rogers | 73/152.56 |
| 3,268,003 | A | | 8/1966 | Essary | 166/35 |
| 3,661,205 | A | | 5/1972 | Belorgey | 166/65 R |
| 3,686,943 | A | * | 8/1972 | Smith | 73/152.56 |
| 3,934,466 | A | | 1/1976 | Curry | 73/151 |
| 3,942,373 | A | | 3/1976 | Rogers | 73/151 |
| 3,994,163 | A | | 11/1976 | Rogers | 73/151 |
| 4,105,071 | A | | 8/1978 | Nicolas et al. | 166/250 |
| 4,125,013 | A | * | 11/1978 | Nicolas et al. | 73/152.56 |
| 4,184,546 | A | | 1/1980 | Nicolas et al. | 166/206 |
| 4,207,765 | A | | 6/1980 | Kiff | 73/151 |
| 4,289,024 | A | | 9/1981 | Basham et al. | 73/151 |
| 4,351,186 | A | | 9/1982 | Moulin | 73/151 |
| 4,402,219 | A | | 9/1983 | Hache | 73/151 |
| 4,448,250 | A | * | 5/1984 | Cooke et al. | 166/255.1 |
| 4,515,010 | A | | 5/1985 | Weido et al. | 73/151 |
| 4,708,204 | A | | 11/1987 | Stroud | 166/255 |
| 4,790,381 | A | | 12/1988 | Armell | 166/241 |
| 5,375,476 | A | * | 12/1994 | Gray | 73/862.331 |
| 5,520,245 | A | | 5/1996 | Estes | 166/66 |

OTHER PUBLICATIONS

PCT International Search Report, International Application No. PCT/GB 02/03604, dated Oct. 15, 2002.

* cited by examiner

*Primary Examiner*—William Neuder
(74) *Attorney, Agent, or Firm*—Moser, Patterson & Sheridan, L.L.P.

(57) ABSTRACT

An apparatus and method of determining the point at which a tubular is stuck within another tubular or a wellbore by applying a tensile or torsional force to the stuck tubular and measuring the response of various locations within the tubular. In addition, the apparatus may be combined with a cutting tool to separate the free portion of the tubular from the stuck portion.

54 Claims, 6 Drawing Sheets

DUAL SENSOR FREEPOINT TOOL

CROSS-REFERENCE TO RELATED APPLICATIONS

This application claims benefit of U.S. provisional patent application Ser. No. 60/310,124, filed Aug. 3, 2001, which is herein incorporated by reference.

BACKGROUND OF THE INVENTION

1. Field of the Invention

The present invention relates to an apparatus and method for use in a wellbore. More particularly, the invention relates to a downhole tool for determining the location of an obstruction in a wellbore. More particularly still, the invention relates to a downhole tool for locating the point at which a tubular such as a drill string is stuck in an opening or a hole such as a hollow tubular or a wellbore.

2. Description of the Related Art

As wellbores are formed, various tubular strings are inserted into and removed from the wellbore. For example, a drill bit and drill string are utilized to form the wellbore which will typically be lined with casing as the bore hole increases in depth. With today's wells, it is not unusual for a wellbore to be several thousand feet deep with the upper portion of the wellbore lined with casing and the lowest portion still open to the earth. As the well is drilled to new depths, the drill string becomes increasingly longer. Because the wells are often non-vertical or diverted, a somewhat tortured path can be formed leading to the bottom of the wellbore where drilling takes place. Because of the non-linear path through the wellbore, the drill string can become bound or other wise stuck in the wellbore as it moves axially or rotationally. The issues related to a stuck drill string are obvious. All drilling operations must be stopped and valuable rig time lost. Because the drill string is so long, determining the exact location of the obstruction can be difficult.

Because of the length of the drill string and the difficulty in releasing a stuck drill string it is useful to know the point at which one tubular is stuck within another tubular or within a wellbore. Such knowledge makes it possible to accurately locate tools or other items above, adjacent, or below the point at which the tubular is stuck. The prior art includes a variety of apparatuses and methods for ascertaining the point at which a tubular is stuck.

The most common apparatuses and methods employ the principle that the length of the tubular will increase linearly when a tensile force is applied, so long as the tensile force applied is within a given range. The range of linear response is based on many factors, including the mechanical properties of the tubular such as the yield strength of the material. One method of determining an approximate location for the sticking point of a tubular involves applying a known tensile force to the tubular and measuring the elongation at the surface of the well. If the total length of the tubular within the second tubular or wellbore is known, then the total amount of theoretical elongation can be calculated, based on the assumption that the applied force is acting on the entire length of the tubular. Comparing the measured elongation to the theoretical elongation, one can estimate the sticking point of the tubular. If the measured elongation is fifty percent of the theoretical elongation, then it is estimated that the tubular is stuck at a point that is approximately one half of the length of the tubular from the surface. Several factors have a negative impact on the accuracy of this method.

Among these are the friction between the tubular and the surface in which it is stuck and the changes in the properties of the tubular due to corrosion or other conditions.

This same principle of applying a known force to the stuck tubular and measuring the response can also be used to more accurately determine the location of the sticking point. By placing a freepoint tool at the end of a run in string within the stuck tubular, one can accurately determine the sticking point location by placing the tool at various locations within the tubular, applying a known tensile force, and accurately measuring the elongation of the tubular at the location of the freepoint tool. A similar method utilizes a known torque applied to the tubular and measurement of the rotational displacement. In both methods, a freepoint tool is placed at a location within the tubular and then anchored to the tubular at each end of the freepoint tool. If the portion of the pipe between the anchored ends of the freepoint tool is elongated when a tensile force is applied (or twisted when a torsional force is applied) at the surface to the stuck tubular, it is known that at least a portion of the freepoint tool is above the sticking point. If the freepoint tool does not record any elongation when a tensile force is applied (or twisting when a torsional force is applied) at the surface to the stuck tubular, it is known that the freepoint tool is completely below the sticking point. By moving the freepoint tool within the stuck tubular and measuring the response in different locations to a force applied at the surface, the location of the sticking point may be accurately determined.

A common problem associated with freepoint tools is the need to provide both a means of positively anchoring the ends of the freepoint tool when a measurement is being taken and also being able to freely move the tool to a new location within the tubular. A common type of anchoring system utilizes a bow spring to anchor the freepoint tool to the inside surface of the stuck tubular. A problem associated with this system is that the bow springs are in constant contact with the inside surface of the stuck tubular as the freepoint tool is being lowered into the stuck tubular on a run in string. It is difficult to set the bow springs so that there is enough friction between the spring and the stuck tubular to allow for accurate measurement of the response to a force on the stuck tubular, yet permit the freepoint tool to be moved from one location to another.

Another method of anchoring a freepoint tool to a stuck tubular utilizes motorized "dog type" anchors. With these systems, a motor is typically used in conjunction with a gear system or other mechanical arrangement to actuate the anchors and drive them into the wall of the stuck tubular. To ensure positive engagement of the anchoring system, the motor is typically driven until it is stalled by the wall of the stuck tubular restricting movement of the anchor. This technique can lead to overheating of the motor and eventual failure of the motor windings. Another problem associated with this type of arrangement occurs when attempting to anchor the freepoint tool in a horizontal section of a stuck tubular. In this situation, the anchor must lift up the freepoint tool from the bottom of the stuck tubular to fully engage anchors. The weight of the freepoint tool may stall the motor before the anchor system is fully engaged and therefore prevent a measurement of the response of the tubular.

In addition, protecting the freepoint tool sensors that detect the response of the tubular from the harsh environment of a wellbore is another problem. The sensors utilized are typically fragile components that can not operate in the extreme pressures and temperatures often found in a wellbore. Typical freepoint tool designs utilize an oil-filled chamber in combination with a piston to hydrostatically balance them with the wellbore pressure, but this complicates the assembly and repair of the freepoint tool and disturbs measurements at high temperatures.

Another problem associated with freepoint tools is the need to generate large forces acting on the tubular at the surface in order to generate a response that is capable of being detected by the sensors of the freepoint tool. This problem is exacerbated by sensors that do not have sufficient sensitivity or accuracy. An additional problem exists in the need to accurately and quickly reset the freepoint tool after a measurement has been taken so that a new measurement may be taken in a different location within the tubular. It is necessary to quickly reset the freepoint tool in situations where measurements will be taken in several different locations. It is also necessary to reset the freepoint tool in an extremely accurate manner due to the small magnitude of the responses that will be measured by the freepoint tool.

A need therefore exists to provide a more accurate means for locating a point where a tubular is stuck in a wellbore. There is a further need for both a means to positively anchor the ends of a freepoint tool when a measurement is being taken and to freely move the tool to a new location within the tubular apparatus for new measurement locations. A further need exists for a means of protecting the freepoint tool sensors that detect the response of the tubular from the harsh environment of a wellbore. Still a further need exists for a freepoint tool that does not require the generation of large forces acting on the stuck tubular in order to generate a response that is capable of being detected by the sensors of the freepoint tool. Yet another need exists for a freepoint tool that may be accurately and quickly reset before measurements are taken to determine the response.

SUMMARY OF THE INVENTION

The present invention generally relates to an apparatus and method for determining the sticking point of a tubular disposed within a second tubular or a wellbore through the use of a device commonly known as a freepoint tool.

In one aspect of the invention, the apparatus contains spring-loaded anchoring mechanisms that provide reliable means of solidly attaching the freepoint tool to a stuck tubular and allow easy retrieval of the freepoint tool to the surface.

In another aspect of the invention, the apparatus contains anchoring mechanisms which are fully retractable to allow for easy relocation of the freepoint tool within the stuck tubular.

In yet another aspect of the invention, the apparatus contains a sealed housing that protects sensitive components of the freepoint tool from the outside environment.

In another aspect of the invention, the apparatus contains an outer sleeve which allows for quick, simple and accurate resetting of the freepoint tool sensor components.

In another aspect of the invention, the apparatus contains a unique angular displacement sensor comprised of two sensor coils and a magnet pole piece acting through a sealed housing.

In another aspect, the apparatus may be used with a string shot to loosen a connection between two portions of the stuck tubular. After the sticking point has been determined, a torque may be applied to the tubular. Thereafter, a string shot may be ignited proximate the connection to loosen the connection.

In another aspect, the apparatus may be used with a cutting tool to separate a free portion of the tubular from a stuck portion. The cutting tool may include a mechanical cutter, a chemical cutter, a jet cutter, or a radial cutting torch.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
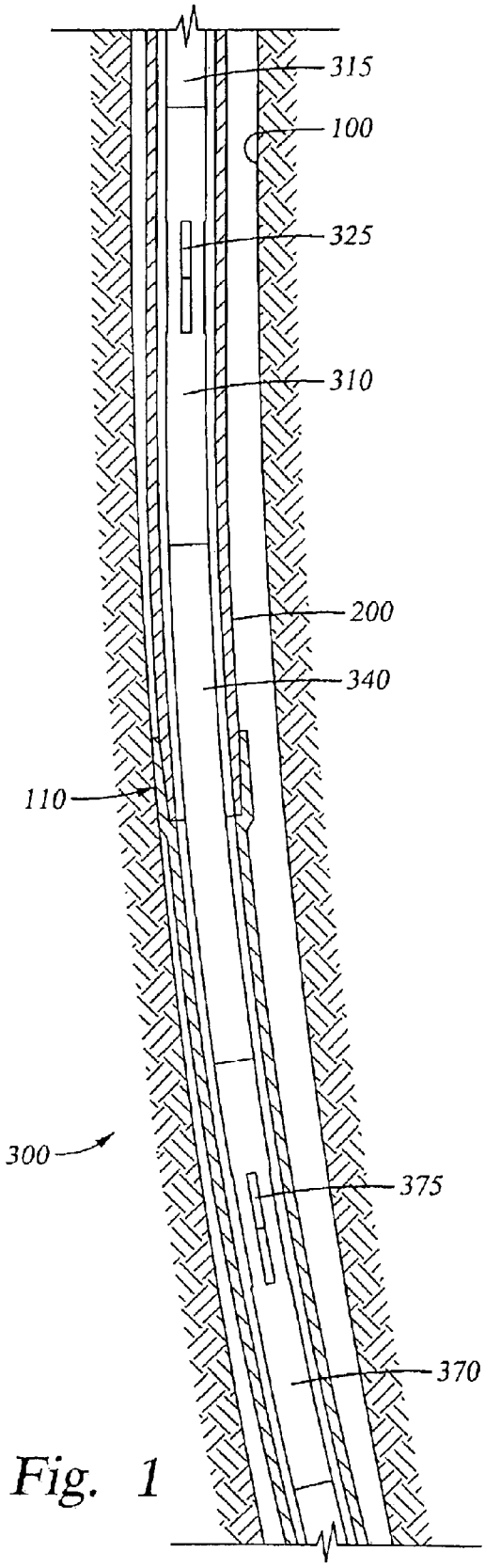
FIG. 1 is a partial section view of a freepoint tool within a drill string that is stuck in a wellbore.

FIG. 1 is a partial section view of a freepoint tool 300 attached to the end of a run in string 315. Both the run in string 315 and the freepoint tool 300 are located within a drill string 200 stuck in a wellbore 100 at sticking point 110. The freepoint tool 300 is comprised of an upper anchor assembly 310, a dual sensor assembly 340 and a lower anchor assembly 370. The upper anchor assembly 310 and the lower anchor assembly 360 provide a means of attaching each end of the freepoint tool 300 to the stuck drill string 200, while the dual sensor assembly 340 is capable of measuring the response of the drill string 200 to either a tensile or torsional force applied at the surface.

Figure 2:
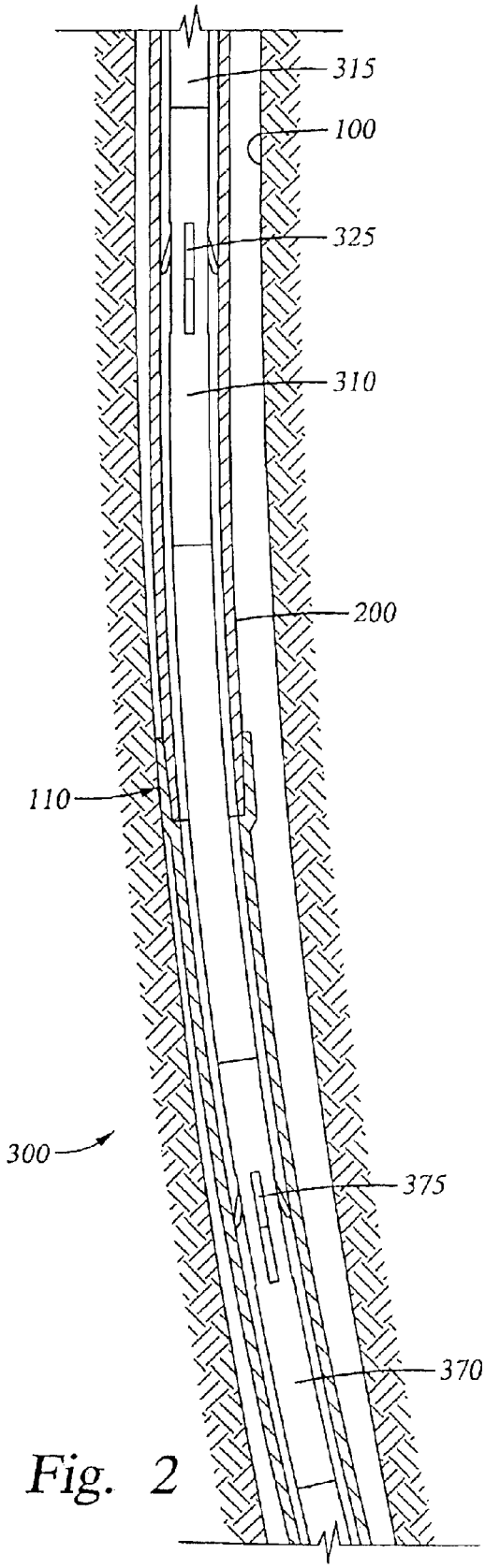
FIG. 2 is a partial section view of a freepoint tool anchored within a drill string that is stuck in a wellbore.

FIG. 2 is a partial section view of a run in string 315 with a freepoint tool 300 anchored within a drill string 200 that is stuck in a wellbore 100 at sticking point 110. In this Figure, the upper anchor arms 325 and the lower anchor arms 375 are shown engaged with the inner surface of the drill string 200. The upper anchor arms 325 of the upper anchor assembly 310 and lower anchor arms 375 of the lower anchor assembly 370 provide a means of positively attaching each end of the freepoint tool 300 to the drill string 200. It must be noted that although the anchor assemblies 310, 370 are engaged, it is contemplated that the freepoint tool 300 may be dragged or moved along the tubular during operation.

Figure 2A:
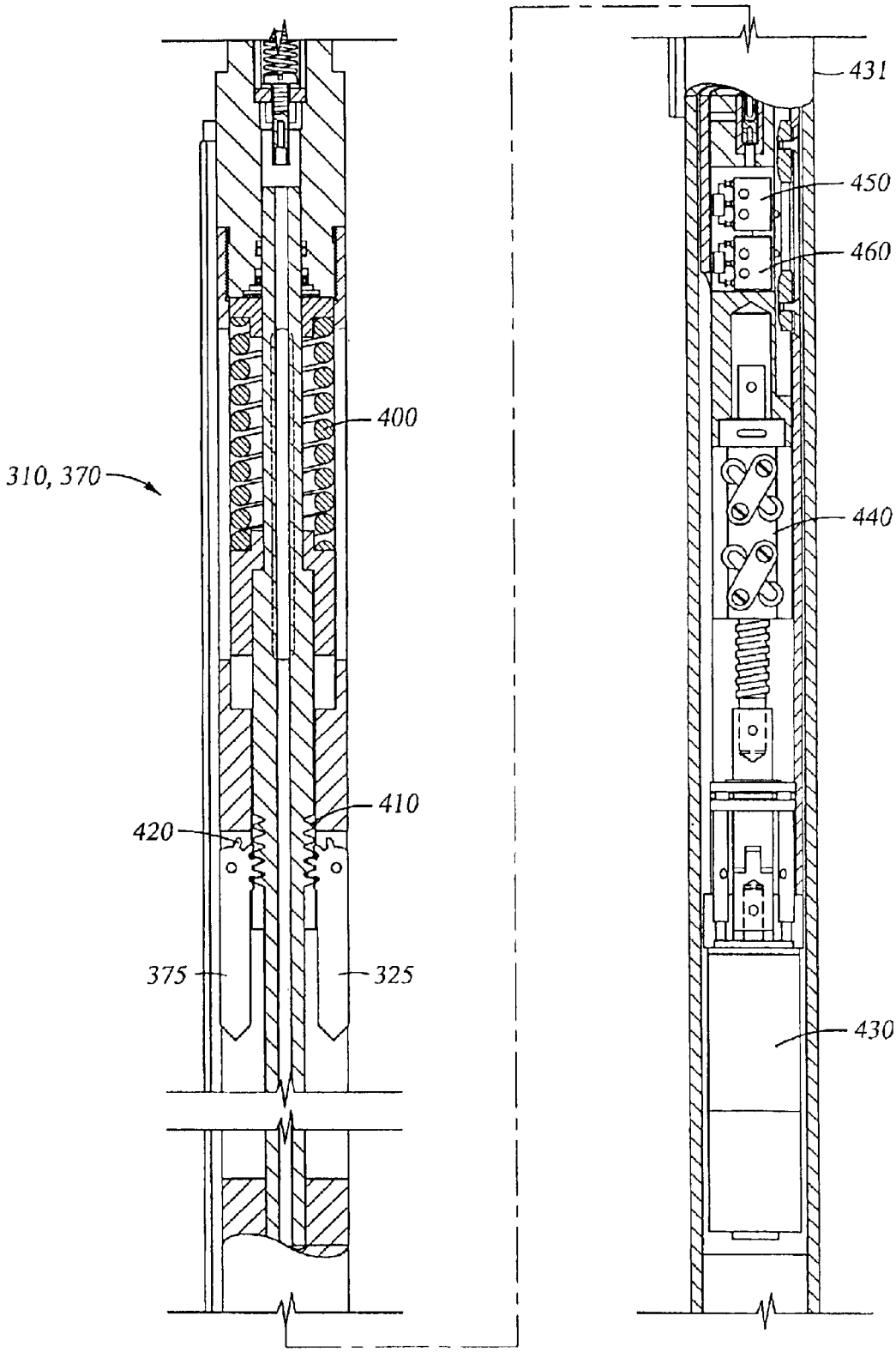
FIG. 2A is a partial section view of the anchoring system utilized in the upper anchor assembly and the lower anchor assembly with the anchor arms retracted.
Figure 2B:
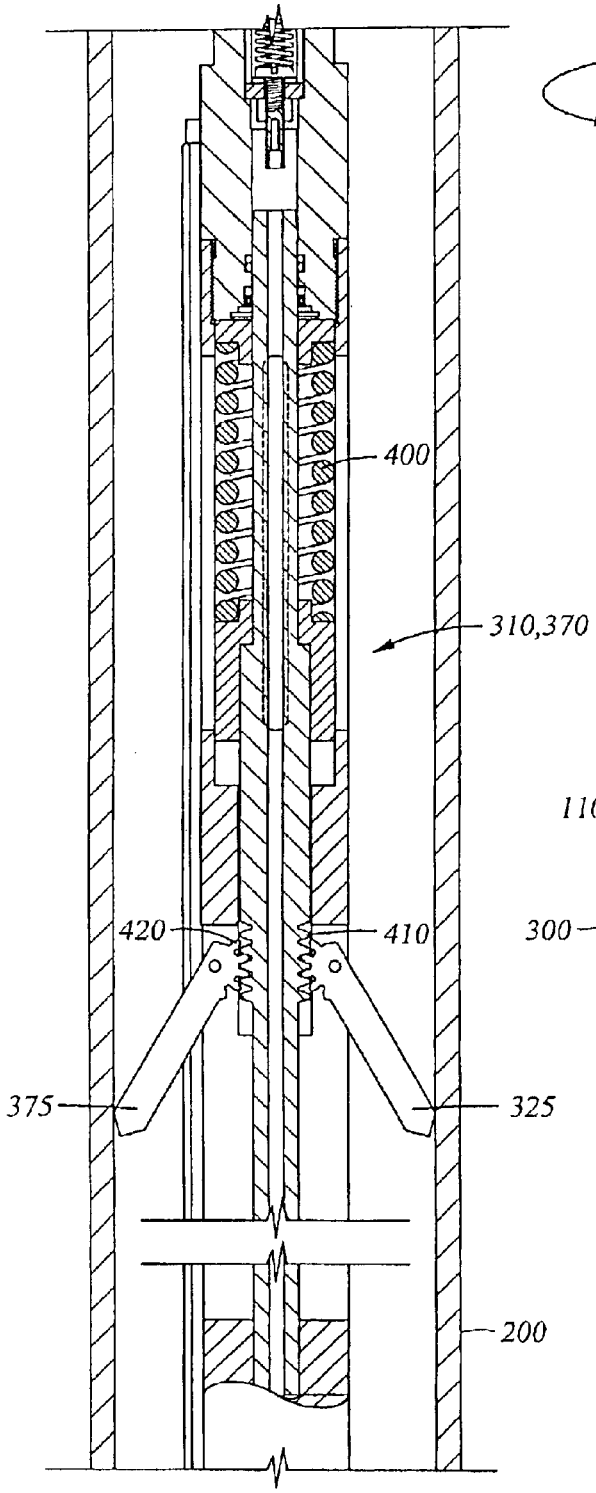
FIG. 2B is a partial section view of the anchoring system utilized in the upper anchor assembly and the lower anchor assembly with the anchor arms extended.

FIG. 2A is a partial section view of the anchoring systems utilized in both the upper anchor assembly 310 and the lower anchor assembly 370 with the anchor arms 325, 375 retracted. FIG. 2B is a partial section view of the anchoring system utilized in both the upper anchor assembly 310 and the lower anchor assembly 370 with the anchor arms 325, 375 extended. In this system, the anchor arms are outwardly biased by spring 400. The spring acts upon the rack 410, which rotates the pinion 420 at the end of the anchor arms 325, 375 so that the anchor arms 325, 375 are in an extended position. The anchor arms 325, 375 are retracted through the use of an electric motor 430 and a mechanical assembly that forces the rack 410 in the opposite direction from which the spring 400 forces the rack 410. The electric motor 430 is attached to ballscrew assembly 440, which translates the rotational motion from the shaft of the motor 430 into linear motion. This linear motion is imparted to the rack 410, which compresses the spring 400 and acts upon the pinion 420 at one end of the anchor arms 325, 375. As the rack 410 acts upon the pinion 420, the anchor arms 325, 375 are retracted. Limit switches 450 and 460 turn the motor 430 on and off before the mechanical components reach either end of their travel, thereby preventing the motor 430 from stalling and damaging internal components of the motor 430.

There are several advantages to the anchoring system 320 heretofore described. One significant advantage is that the spring 400 provides a simple and reliable means of positively attaching the anchor arms 325, 375 to the inside surface of a stuck tubular 200. This means of anchoring provides a stiff connection between the freepoint tool and the stuck tubular 200 which includes little or no hysterisis (i.e. allows the components of the freepoint tool to return to the same position after the application of a force to the tubular 200 that the components were in before the force was applied). In addition, the electric motor 430 is used to fully retract the anchor arms 325, 375 so that the freepoint tool may be easily moved within a stuck tubular 200 to obtain measurements at different locations within the stuck tubular 200. The anchoring system 320 and the light weight of this freepoint tool design also provide an advantage in applications where the freepoint tool is being anchored to a stuck tubular 200 in a horizontal position. The spring 400 can be selected to provide more than adequate force to lift the freepoint tool and extend the anchor arms 325, 375 until they are engaged in the wall of the stuck tubular 200. Because there is no reliance on any type of motor to extend the anchor arms 325, 375, the reliability of the anchoring system 320 is increased.

Another advantage of the anchoring system 320 is that the freepoint tool may be easily retrieved and brought to the surface in the event of a failure of the motor 430. This is due to the angle of the fully extended anchor arms 325, 375 and the fact that the arms are loaded by the spring 400 which allows the arms 325, 375 to collapse if they encounter any restriction within the tubular 200 while being retrieved. The design of anchoring system 320 is such that the extended anchoring arms 325, 375 will provide a stiff connection between the freepoint tool 300 (shown in FIG. 2) and the stuck tubular 200 if there is only a tensile or torsional force applied to the stuck tubular. However, if there is a an upward force applied at the surface to the freepoint tool 300, the angle of the arms 325, 375 and the fact that they are loaded by spring 400 will allow the freepoint tool 300 to move toward the surface, even with the arms 325, 375 extended.

An additional advantage of the present invention is that the anchoring system 320 is contained in a modular, field-replaceable assembly. The anchoring system 320 is a module and consists of anchor electronics (not shown), DC motor 430 and gearbox (not shown), couplings (not shown), ball screw assembly 440, and limit switches 450 and 460. All of these components are shown within acuator housing 431. Electrical connections (not shown) are contained in the end of the assembly that permit power to flow to the anchor electronics (and eventually the motor 430) or through the anchoring system 320 to other components located below it. The assembly is simply screwed into a sub (not shown) that mates to the anchor body housing (not shown) containing the rack 410 and anchor arms 325, 375. The electrical and mechanical connections (not shown) mate automatically. Minor adjustments of the limit switches 450, 460 wedge locations (to set anchor open and closed positions) are all that are required to finalize the installation of a replacement anchor actuator assembly.

Figure 3:
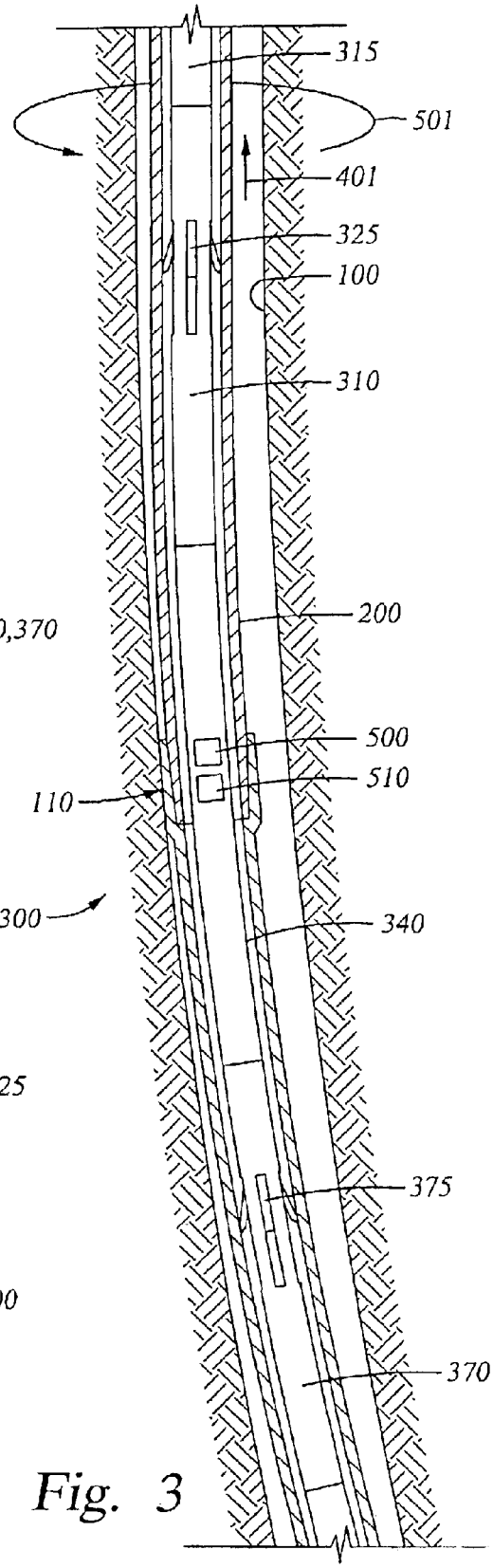
FIG. 3 is partial section view of a freepoint tool anchored within a drill string that is stuck in a wellbore with a tensile and torsional force applied to the drill string.

FIG. 3 is partial section view of a freepoint tool 300 anchored within a drill string 200 that is stuck in a wellbore 100 at sticking point 110 with a tensile force 401 and torsional force 501 applied at the surface to the drill string 200. As the drill string 200 is placed in tension at the surface, the portion of the drill string 200 above the sticking point 110 will be elongated. The amount of elongation of the drill string 200 which is between the sticking point 110 and the upper anchor arms 325 will be detected by a linear voltage differential transformer 500 (LVDT) in the dual sensor assembly 340 of the freepoint tool 300. If the upper anchor arms 325 were located at a point below the sticking point 110, there would be no elongation detected by the LVDT 500. If the lower anchor arms 375 were located at a point above the sticking point, the LVDT 500 would detect elongation of the entire portion of the drill string 200 between the upper anchor arms 325 and the lower anchor arms 375. By applying a known force at the surface to the drill string 200 and measuring the response of the LVDT 500, it can be determined if the anchor arms 325 and 375 of the freepoint tool 300 are above, on either side, or below the sticking point 110. In this manner, the location of the sticking point 110 may be precisely located.

Similarly, as the drill string 200 is placed in torsion at the surface, the portion of the drill string 200 above the sticking point 110 will be angularly displaced. The amount of angular displacement of the drill string 200 which is between the sticking point 110 and the upper anchor arms 325 will be detected by the angular displacement sensor 510 in the dual sensor assembly 340 of the freepoint tool 300. If the upper anchor arms 325 were located at a point below the sticking point 110, there would be no angular displacement detected by the angular displacement sensor 510. If the lower anchor arms 375 were located at a point above the sticking point, the angular displacement sensor 510 would detect angular displacement of the entire portion of the drill string 200 between the upper anchor arms 325 and the lower anchor arms 375. By applying a known torsional force at the surface to the drill string 200 and measuring the response of the angular displacement sensor 510, it can be determined if the anchor arms 325 and 375 of the freepoint tool 300 are above, on either side, or below the sticking point 110. In this manner, the location of the sticking point 110 may be precisely located.

Figure 4:
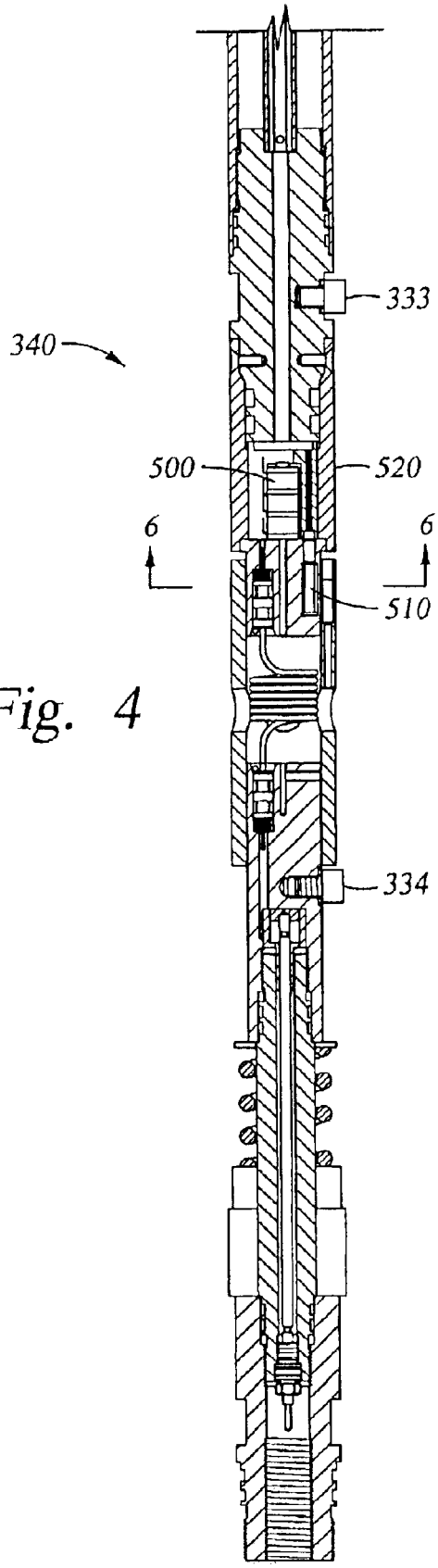
FIG. 4 is a section view of the dual sensor assembly.

FIG. 4 is a section view of the dual sensor assembly 340. The dual sensor assembly 340 contains a common linear voltage differential transformer (LVDT) 500 for measuring linear displacement and a unique angular displacement sensor 510 for measuring angular displacement. The LVDT 500 and angular displacement sensor 510 are fully contained within a housing 520 and protected from the harsh outside environment. Operation in extreme temperatures is possible as the present invention is designed for 400° F., but extended excursion to 425° F. are possible. A suitable material for the housing 520 may include a super alloy having a minimum yield strength of about 160,000 psi, more preferably about 240,000 psi. An example of such a super alloy include MP35N, a nickel-cobalt based alloy.

Figure 5:
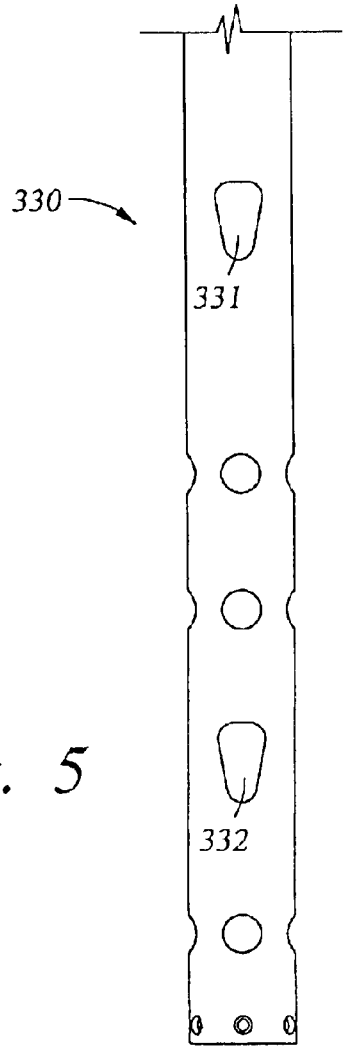
FIG. 5 is a side view of a carrier sleeve.

FIG. 5 is a side view of the carrier sleeve 330. The carrier sleeve 330 surrounds the dual sensor assembly and upper anchor assembly and includes reset slots 331 and 332 in which alignment pins 333 and 334 (shown in FIG. 4) are disposed. The reset slots 331 and 332 serve to reset the pins 333 and 334 both axially and rotationally when the freepoint tool is raised a minimal amount (approximately one-half inch). Before a new measurement can be taken, it is necessary to reset the components of both the LVDT 500 and angular displacement sensor 510 (shown in FIG. 4) after a measurement has been taken while imparting a force upon the stuck tubular. The features of the carrier sleeve 330, particularly the reset slots 331 and 332, allow a quick, simple, and accurate method of resetting the components of the LVDT 500 and angular displacement sensor 510.

Figure 6:
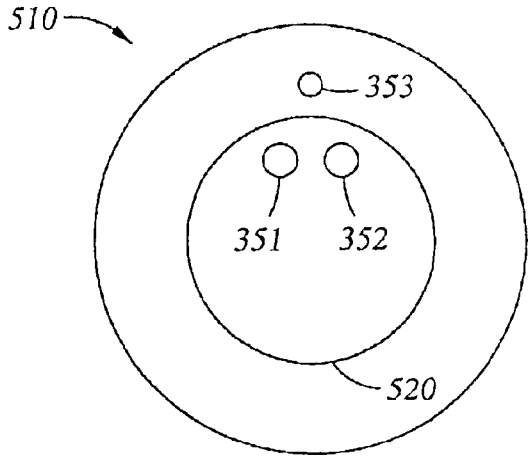
FIG. 6 is a section view of an angular displacement sensor.

FIG. 6 is a section view of the angular displacement sensor 510 taken along section line 6—6 in FIG. 4. The angular displacement sensor 510 employs two sensor coils 351 and 352 placed close to each other in parallel and connected by a bridge circuit. A magnet pole piece 353 acts through the pressure housing 520 (shown in FIG. 4) and modulates the inductance of the sensor coils 351 and 352, adjusting the voltage across the bridge circuit and being detected as an angular displacement by surface equipment. As shown in FIGS. 4 and 6, there is no mechanical connection between the moving components of either the LVDT 500 or the angular displacement sensor 510. This results in sensors that require extremely small forces to actuate them.

The present invention was designed with modularity in mind, grouping components into relatively easy to replace subassemblies. This design addresses many field maintenance issues. Also, not having an oil filled tool eliminates many maintenance issues that previously required depot-level repair facilities to fix and problems and return freepoint tools to service. The design of the present invention such that it is low cost and low maintenance.

The present invention also has the advantage that the entire string is powered only with positive voltage on the wireline (core positive relative to the armor). Negative voltage is reserved on the wireline core for explosive or other desired operations, a feature which enhances the safe operation of the present invention. In addition, the anchor arms are commanded to open and close by pulsing the positive voltage supply (turn off momentarily and turned back on) and the freepoint sensor runs off a positive voltage supply only. The anchors and freepoint tool are essentially turned off during negative voltage supply conditions.

In addition to determining a location where a tubular is stuck in a wellbore, the present invention can also be used as an assembly including a string shot. String shots are well known in the pipe recovery business and include an explosive charge designed to loosen a connection between two tubulars at a certain location in a wellbore. In the case of a tubular string that is stuck in the wellbore, a string shot is especially useful to disconnect a free portion of the tubular string from a stuck portion of the tubular string in the wellbore. For example, after determining a location in a wellbore where a tubular string is stuck, the nearest connection in the tubular string there above is necessarily unthreaded so that the portion of the tubular string which is free can be removed from the wellbore. Thereafter, additional remedial measures can be taken to remove the particular joint of tubular that is stuck in the wellbore.

A string shot is typically a length of explosive material that is formed into the shape of a rope and is run into the wellbore on an electrical wire. The string shot is designed to be located in a tubular adjacent that connection to be unthreaded. After locating the string shot adjacent the connection, the tubular string is rotated from the surface of the well to place a predetermined amount of torque on the string which is measurable but which is inadequate to cause any of the connections in the string to become unthreaded. With this predetermined amount of torque placed on the string, the string shot is ignited and the explosive charge acts as a hammer force on the particular connection between joints. If the string shot operates correctly, the explosion loosens the joints somewhat and the torque that is developed in the string causes that particular connection to become unthreaded or broken while all the other connections in the string of tubulars remain tight. In this manner, the particular connection can be broken while all the other connections which are tightened to a similar torque remain tight.

The free point tool of the present invention, because of its design and robust physical characteristics, can be operated in a wellbore in an assembly that includes a string shot. Because the free point tool of the present invention is not fluid filled and does not include a pressure equalizer system there is no fluid communication between the tool and fluid in the wellbore. Because this communication is unnecessary, the free point tool of the present invention is not as susceptible to damage from hydrostatic pressure caused by the ignition of a string shot explosion adjacent the free point tool. This robust design is impervious to hydrostatic shock and permits the free point tool to be run into the wellbore with a string shot apparatus disposed in the same tubular string.

In use, an apparatus including the free point tool of the present invention and the string shot would be used as follows: the assembly including the free point tool with a string shot disposed there below is run into the wellbore to a point whereby the free point tool straddled that location in the wellbore where the tubular is stuck. Using the anchoring mechanisms described herein, and a combination of tensile and rotational forces, the exact location of the stuck tubular is determined. Thereafter, the assembly is raised in the wellbore to a location wherein the string shot is adjacent that threaded connection between the tubulars just above the point where the tubular is stuck in the wellbore. The tubular string is then placed in rotation from the surface of the well, typically a left handed rotation which would place a torque on the threads of every connection within the tubular string. With the string in torsion, the string shot is ignited and the explosive force acts upon that connection in the tubular string to be broken. The hammer-like force from the ignition of the string shot and the torque placed in the tubular string from the surface of the well causes the string to be broken at the connection just above the point where the tubular is stuck in the wellbore. Thereafter, the assembly including the free point tool and the string shot is removed from the wellbore and the tubular string above the stuck portion can be removed.

The dual sensor freepoint/anchor (DSFP/Anchor) tool of the present invention contains a through-wire circuit to connect to a string shot assembly below the tool (or for other electrically driven devices.) Hence, a freepoint can be determined and a back-off operation performed immediately (if run with a string shot). The DSFP/Anchor tool is also designed to withstand repeated exposures to a string shot (500 grain size) without the need to recalibrate the sensors.

In addition, wireline length has no effect on sensor calibration. The wireline impedance is not in the calibration equation due to the use of pulse telemetry technique. The length of the wireline does not bother transmitting torque and stretch information to the surface in a digital pulse telemetry way. Some tools, such as the Dialog freepoint tool, require re-calibration as the tool is progressively lowered into the well.

Ease of interpretation of freepoint data by use of a surface computerized acquisition system, referred to as a FAS-V system (Freepoint Acquisition System—version V), is also an advantage. Although a portable panel can be used with the DSFP/Anchor tool, it has the same limitations as most other surface instruments. It employs a dial or meter readout to indicate torque or stretch measurements from the downhole string. It is an instantaneous readout and the data is not stored for later retrieval. The portable panel can be used as a backup surface panel (in cases of a FAS-V failure) or for operation of the system on a third party's wireline cable.

The FAS-V system is a computerized data acquisition system specifically geared towards freepointing operations. Freepoint readings can be displayed either on bar graphs (vertical or horizontal), meter readout displays (similar to the portable panel meter readout), or X-Y plots. Data is stored and can be retrieved later for quality analysis or other purposes. It is important to know how the pipe reacts over time as it is strained at the surface (pulled or rotated). This information will indicate how easy it is to transmit torque or stretch to the location measured over time, and is good information to have when determining a freepoint or to determine if a successful back-off can be performed. The X-Y plotting of data is most useful for freepoint measurements.

An X-Y plot is simply the torque and stretch measured data plotted against time. Not only does the display show you the instantaneous reading from both downhole freepoint sensors, but also the "history" of the freepoint reading is displayed on screen. The screen will scroll if data "spills off the edge", and the amount of time displayed on the screen is configurable.

Another advantage of using the FAS-V system with the DSFP/Anchor tool is easy operation. Many tasks are automated with the computer and help improve the quality and timeliness of pipe recovery services. Furthermore, data interpretation is quick and easy to understand further aiding operators to quickly and accurately determine the freepoint.

The FAS-V system includes many other features that duplicate features found in other computerized logging panels. However, it includes additional features not found in other systems such as a configurable database of measured freepoint readings, ability to diagram a well (well schematic) and include it with a printed log, the ability to diagram the tool string, and to produce a job resume on location. The FAS-V also includes hardware and software to acquire, store, and display information from simple pulse logging tools (like a Gamma Ray, Gamma Ray with Neutron, Min./Max. Caliper, and Temperature tools). The freepoint tool system is also fast to operate in the taking of measurements. Some tools, such as the Dialog freepoint tool, require recalibration when the tool transitions between zones of mixed string pipe (e.g. a work string of 2⅜ tubing connected to a string of 2⅞ tubing). This is not an issue with the DSFP/Anchor tool of the present invention.

Additionally, the quick deployment of the anchors arms and quick method of resetting the tool enable fast measurements to be made. Furthermore, oil filled tools with pressure balancing mechanisms are sometime difficult to "calm down" when exposed to quick changes in pressure or temperature. Some time must pass to allow the system to equalize before an accurate freepoint measurement can be made.

Figure 7A:
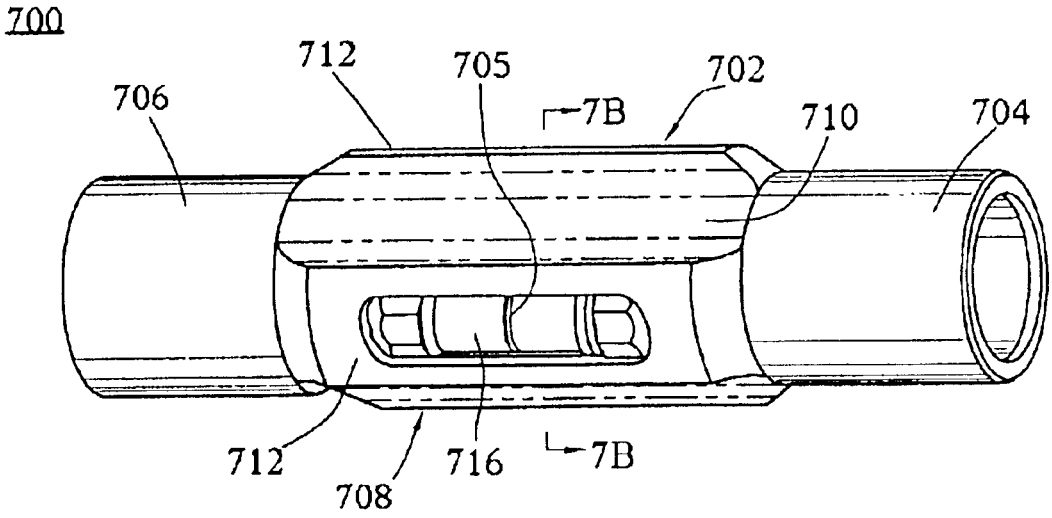
FIG. 7A shows a cutting tool usable with the freepoint tool.
Figure 7B:
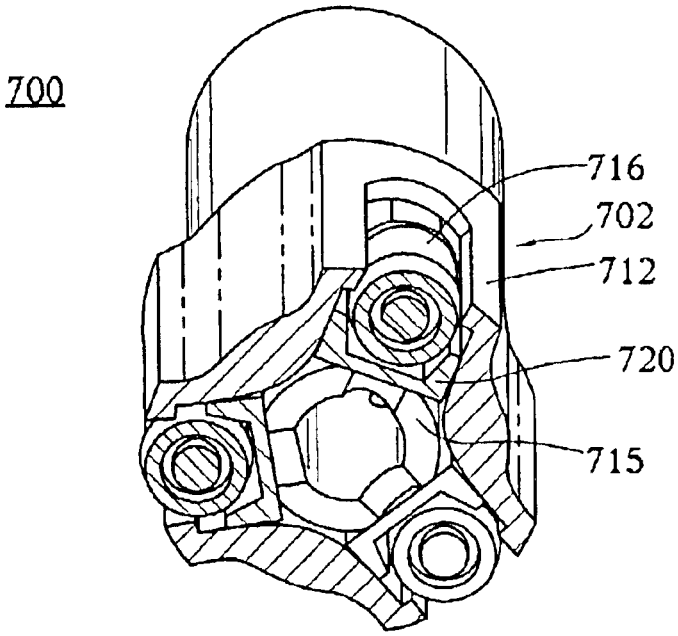
FIG. 7B is a cross-sectional view of the cutting tool.
Figure 7C:
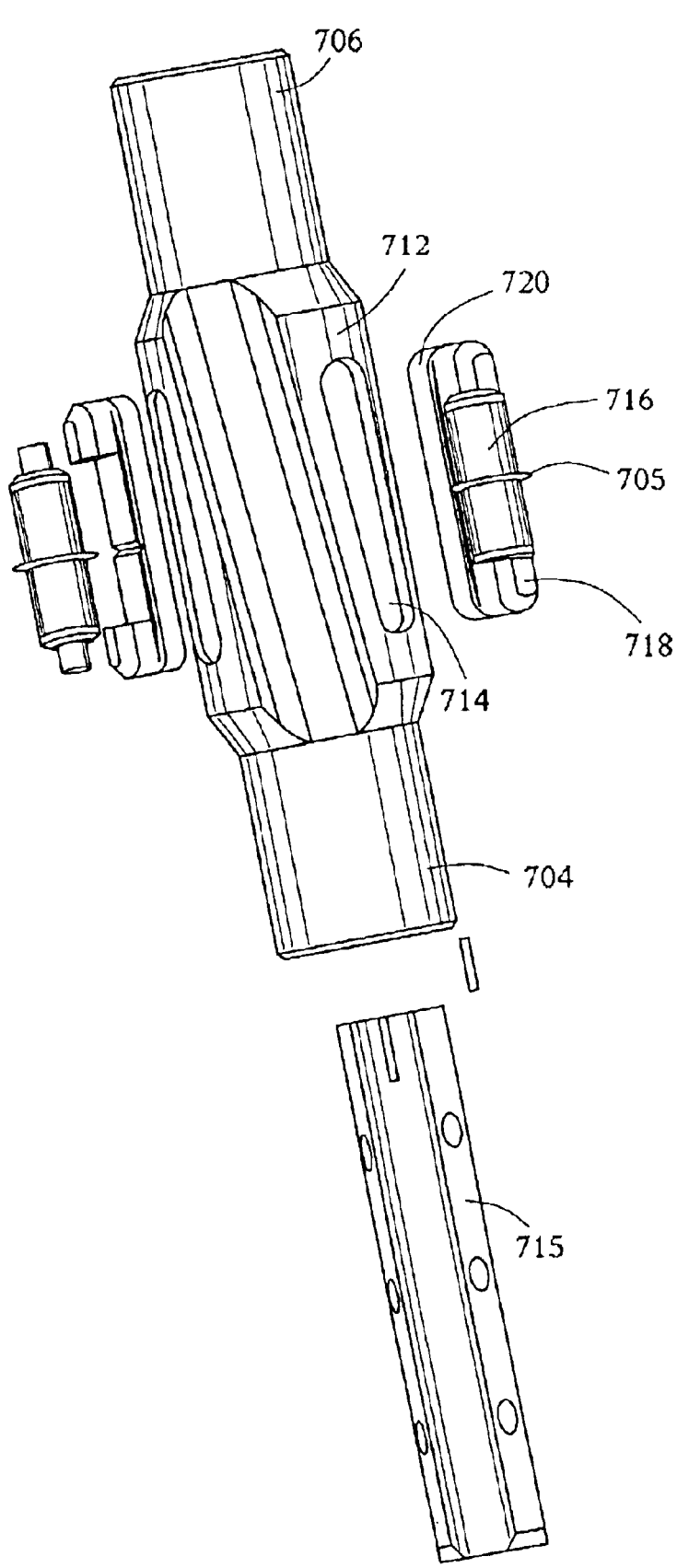
FIG. 7C is an exploded view of the cutting tool.

In another aspect, the freepoint tool 300 may be used in combination with a cutting tool to sever the tubular after the sticking point has been determined. In one embodiment, the freepoint tool 300 may be used with the cutting tool 700 shown in FIG. 7A. FIG. 7B is a cross-sectional view of the cutting tool 700 and FIG. 7C is an exploded view of the cutting tool 700. The tool 700 has a body 702 which is hollow and generally tubular with conventional screw-threaded end connectors 704 and 706 for connection to other components (not shown) of a downhole assembly. The end connectors 704 and 706 are of a reduced diameter (compared to the outside diameter of the longitudinally central body part 708 of the tool 700), and together with three longitudinal flutes 710 on the central body part 708, allow the passage of fluids between the outside of the tool 700 and the interior of a tubular therearound (not shown). The central body part 708 has three lands 712 defined between the three flutes 710, each land 712 being formed with a respective recess 714 to hold a respective roller 716. Each of the recesses 714 has parallel sides and extends radially from the radially perforated tubular core 715 of the tool 700 to the exterior of the respective land 712. Each of the mutually identical rollers 716 is near-cylindrical and slightly barreled with a single cutter 705 formed thereon. Each of the rollers 716 is mounted by means of a bearing 718 (FIG. 7C) at each end of the respective roller for rotation about a respective rotation axis which is parallel to the longitudinal axis of the tool 700 and radially offset therefrom at 120-degree mutual circumferential separations around the central body 708. The bearings 718 are formed as integral end members of radially slidable pistons 720, one piston 720,being slidably sealed within each radially extended recess 714. The inner end of each piston 720 (FIG. 7B) is exposed to the pressure of fluid within the hollow core of the tool 700 by way of the radial perforations in the tubular core 715.

By suitably pressurizing the core 715 of the tool 700, the pistons 720 can be driven radially outwards with a controllable force which is proportional to the pressurization, thereby forcing the rollers 716 and cutters 705 against the inner wall of a tubular. Conversely, when the pressurization of the core 715 of the tool 700 is reduced to below the ambient pressure immediately outside the tool 700, the pistons 720 (together with the piston-mounted rollers 716) are allowed to retract radially back into their respective recesses 714. Although three rollers 716 are disclosed herein, it is contemplated that the cutting tool 700 may include one or more rollers 716.

In operation, the freepoint tool 300 and the cutting tool 700 may be run into the wellbore on a wireline (not shown). The wireline serves to retain the weight of the tools 300, 700 and also provide power to actuate the tools 300, 700. After the freepoint tool 300 determines the sticking point in a manner described above, the cutting tool 700 may be positioned at the desired point of separation. Thereafter, power may be supplied through the wireline to actuate one or more pumps to provide pressurized fluid to the cutting tool 700. In one embodiment, the wireline may comprise a multiconductor wire to facilitate the transmission of signals to the tools

300, 700. The pressure forces the pistons 720 and the rollers 716 with their cutters 705 against the interior of the tubular. Then, the cutting tool 700 is rotated in the tubular, thereby causing a groove of ever increasing depth to be formed around the inside of the tubular 750. With adequate pressure and rotation, the tubular is separated into an upper and lower portions. Thereafter, the rollers 716 are retracted and the tools 300, 700 may be removed from the wellbore. One advantage of combining a cutting tool with a freepoint tool is that the stuck tubular may be separated at any point of separation. Whereas, the use of the string shot is restricted to a connection in the tubular. Further, the combined tools allow the operation to be performed in a single run, thereby saving time and expense.

In additional to mechanical cutting tools 700, the present invention contemplates the combination of the freepoint tool 300 with other types of cutting tools such as jet cutters, radial cutting torch, and chemical cutters. A jet cutter is a circular shaped explosive charge that severs the tubular radially. A radial cutting torch ("RCT") is a mixture of metals (similar to thermite) in combination with a torch body and nozzle that directs a hot flame against the inner diameter of a tubular, thereby severing the tubular. A chemical cutter is a chemical (e.g., Bromine Triflouride) that is forced through a catalyst sub containing oil/steel wool mixture. The chemical reacts with the oil and ignites the steel wool, thereby increasing the pressure in the tool 700. The increased pressure then pushes the activated chemical through one or more radially displaced orifices which directs the activated chemical toward the inner diameter of the tubular to sever the tubular.

While foregoing is directed to the preferred embodiment of the present invention, other and further embodiments of the invention may be devised without departing from the basic scope thereof, and the scope thereof is determined by the claims that follow.

What is claimed is:

1. A freepoint tool for use in a tubular in a wellbore, comprising:

a housing connectable to a conveyance member for conveying the tool into the wellbore;

at least one anchoring mechanism for connecting the tool to the tubular;

a rack and pinion assembly for facilitating linear motion of the anchoring mechanism;

a first sensor for detecting linear displacement within the tubular; and a second sensor for detecting angular displacement within the tubular.

2. The tool of claim 1, wherein the sensor for detecting angular displacement, comprises:

two sensor coils arranged in parallel and connected to each other in a bridge circuit; and a magnet pole member for modulating the inductance of the sensor coils and adjusts the voltage across the bridge.

3. The tool of claim 1, wherein the at least one anchoring mechanism includes one or more arms that are outwardly biased by a spring.

4. The tool of claim 3, wherein the arms are collapsible towards a body of the tool upon contact with a restriction in the tubular as the tool moves axially within the tubular.

5. The tool of claim 1, wherein the sensors for detecting linear and angular displacement are contained within the housing.

6. The tool of claim 1, wherein the housing comprises a super alloy.

7. The tool of claim 6, wherein the super alloy has a minimum yield strength of about 160,000 psi.

8. The tool of claim 6, wherein the super alloy has a minimum yield strength of about 240,000 psi.

9. The tool of claim 1, further comprising one or more alignment pins and an external sleeve for resetting the sensors to a known relative axial and angular position.

10. The tool of claim 1, wherein power is supplied to the tool using a wireline.

11. The tool of claim 10, wherein the at least one anchoring mechanism is actuated by pulsing a voltage.

12. The tool of claim 1, further comprising one or more explosive charges.

13. The tool of claim 1, further comprising a cutting tool.

14. The tool of claim 13, wherein the cutting tool comprises a mechanical cutting tool.

15. The tool of claim 13, wherein the cutting tool comprises one or more explosive charges.

16. The tool of claim 13, wherein the cutting tool comprises a jet cutter.

17. The tool of claim 13, wherein the cutting tool comprises a chemical cutter.

18. The tool of claim 13, wherein the cutting tool comprises a radial cutting torch.

19. A method of separating a free portion of a tubular from a stuck portion of the tubular, comprising:

determining a sticking point of the tubular using a freepoint tool, comprising:

positioning the freepoint tool in the tubular, the freepoint tool including at least one anchoring mechanism;

anchoring the tool in the tubular;

applying at least one force to the tubular while operating at least one sensor;

collecting a measurement from the at least one sensor;

comparing the measurement to a known value; and resetting the at least one sensor by engaging at least one pin in at least one reset slot disposing a cutting tool proximate a point of desired separation;

actuating the cutting tool; and separating the free portion from the stuck portion.

20. The method of claim 19, wherein the cutting tool comprises a mechanical cutting tool.

21. The method of claim 20, wherein the mechanical cutting tool includes:

a body having at least one opening formed in a wall thereof; and at least one radially extendable cutter arranged to extend from the opening to contact an inside wall of the tubular.

22. The method of claim 19, wherein the cutting tool comprises one or more explosive charges.

23. The method of claim 19, wherein the cutting tool comprises a chemical cutter.

24. The method of claim 19, wherein the cutting tool comprises a radial cutting torch.

25. The method of claim 19, wherein the at least one force is a tensile force and the at least one sensor is a linear displacement sensor.

26. The method of claim 19, wherein the at least one force is a torsional force and the at least one sensor is a torsion sensor.

27. The method of claim 19, further comprising releasing the tool from the tubular.

28. The method of claim 27, further comprising moving the tool to another location within the tubular.

29. A method of locating a sticking point of a tubular in a wellbore, comprising:

positioning a freepoint tool in the tubular in the tubular, the freepoint tool having at least one torsional sensor;

applying a torsional load to the tubular;

sensing the associated torsional deflection of the tubular proximate the freepoint tool;

resetting the at least one torsional sensor by engaging at least one alignment pin in at least one reset slot; and using the sensed deflection to locate the sticking point.

30. The method of claim 29, wherein the torsional sensor comprises:

two sensor coils arranged in parallel and connected to each other in a bridge circuit; and a magnet pole member for modulating the inductance of the sensor coils and adjusts the voltage across the bridge.

31. The method of claim 30, further comprising severing the tubular proximate the sticking point, all in a single operation.

32. A freepoint and cutting tool for use in a tubular in a wellbore, comprising:

at least one anchoring mechanism for connecting the tool to the tubular;

at least one sensor for sensing deflection of the tubular; and at least one cutter for cutting the tubular, the at least one cutter radially extendable from a body.

33. The tool of claim 32, further comprising a housing connectable to a conveying member for conveying the tool into the wellbore.

34. The tool of claim 33, wherein the conveyance member comprises a wireline.

35. The tool of claim 34, wherein the wireline comprises a conductor.

36. The tool of claim 35, wherein the at least one sensor is operatively connected to the conductor.

37. The tool of claim 35, wherein the at least one cutter is operatively connected to the conductor.

38. The tool of claim 35, wherein the conductor carries a first signal to operate the at least one sensor and a second signal to operate the at least one cutter.

39. The tool of claim 35, wherein the at least one sensor operates on positive voltage.

40. The tool of claim 35, further comprising one or more explosive charges.

41. The tool of claim 40, wherein the one or more explosive charges are actuatable using negative voltage.

42. A method of separating a free portion of a tubular from a stuck portion of the tubular in a single run, comprising:

lowering a freepoint tool and a cutting tool into a wellbore;

determining a sticking point of the tubular using the freepoint tool;

disposing the cutting tool proximate a point of desired separation;

actuating the cutting tool, thereby extending at least one cutter radially outward; and separating the free portion from the stuck portion.

43. A freepoint tool for use in a tubular in a wellbore, comprising a housing connectable to a conveyance member for conveying the tool into the wellbore;

at least one anchoring mechanism for connecting the tool to the tubular, the at least one anchoring mechanism includes one or more arms that are outwardly biased by a spring and are retractable towards the body of the tool by a motor and a mechanical assembly providing linear motion, wherein the mechanical assembly includes a ballscrew assembly;

a sensor for detecting linear displacement within the tubular; and a sensor for detecting angular displacement within the tubular.

44. A freepoint tool for use in a tubular in a wellbore, comprising a housing connectable to a conveyance member for conveying the tool into the wellbore;

at least one anchoring mechanism for connecting the tool to the tubular, a sensor for detecting linear displacement within the tubular;

a sensor for detecting angular displacement within the tubular; and a mechanical cutting tool having a body and at least one radially extendable cutter arranged to extend from at least one opening formed in the body to contact an inside wall of the tubular.

45. The tool of claim 44, wherein at least two cutters are substantially equally spaced around the body of the mechanical cutting tool.

46. The tool of claim 44, wherein the at least one cutter is freely rotatable about an axis which is substantially parallel to the longitudinal axis of the body of the mechanical cutting tool.

47. The tool of claim 46, wherein the mechanical cutting tool rotates about an axis substantially coincidental to the longitudinal axis of the tubular therearound.

48. A freepoint and cutting tool for use in a tubular in a wellbore, comprising:

at least one anchoring mechanism for connecting the tool to the tubular, wherein the at least one anchoring mechanism is actuated by pulsing a positive voltage;

at least one sensor for sensing deflection of the tubular;

at least one cutter for cutting the tubular; and a housing connectable to a wireline having a conductor.

49. A freepoint tool for use in a tubular in a wellbore, comprising a housing connectable to a conveyance member for conveying the tool into the wellbore, wherein the housing comprises a super alloy having a minimum yield strength of about 240,000 psi;

at least one anchoring mechanism for connecting the tool to the tubular, a first sensor for detecting linear displacement within the tubular; and a second sensor for detecting angular displacement within the tubular.

50. A freepoint tool for use in a tubular in a wellbore, comprising a housing connectable to a conveyance member for conveying the tool into the wellbore;

at least one anchoring mechanism for connecting the tool to the tubular, a first sensor for detecting linear displacement within the tubular;

a second sensor for detecting angular displacement within the tubular; and one or more alignment pins and an external sleeve for resetting the sensors to a known relative axial and angular position.

51. A freepoint tool for use in a tubular in a wellbore, comprising:

a housing connectable to a conveyance member for conveying the tool into the wellbore;

at least one anchoring mechanism for connecting the tool to the tubular, wherein the at least one anchoring mechanism is actuated by pulsing a voltage;

a first sensor for detecting linear displacement within the tubular;

a second sensor for detecting angular displacement within the tubular; and wherein power is supplied to the tool using a wireline.

52. A freepoint tool for use in a tubular in a wellbore, comprising a housing connectable to a conveyance member for conveying the tool into the wellbore;

at least one anchoring mechanism for connecting the tool to the tubular, a first sensor for detecting linear displacement within the tubular;

a second sensor for detecting angular displacement within the tubular; and a cutting tool.

53. The freepoint tool of claim 52, wherein the cutting tool comprises a jet cutter.

54. The freepoint tool of claim 52, wherein the cutting tool comprises a radial cutting torch.

* * * * *